US006540304B2

(12) United States Patent
Southern

(10) Patent No.: US 6,540,304 B2
(45) Date of Patent: Apr. 1, 2003

(54) WATER SPRAY ASSEMBLY

(75) Inventor: Philip W. Southern, Shinnston, WV (US)

(73) Assignee: Southern Mine Service, Shinnston, WV (US)

( * ) Notice: Subject to any disclaimer, the term of this patent is extended or adjusted under 35 U.S.C. 154(b) by 62 days.

(21) Appl. No.: 09/799,713

(22) Filed: Mar. 7, 2001

(65) Prior Publication Data

US 2001/0045472 A1 Nov. 29, 2001

Related U.S. Application Data

(60) Provisional application No. 60/188,170, filed on Mar. 10, 2000.

(51) Int. Cl.[7] ..... E21C 45/00; E21C 25/14; B05B 1/28

(52) U.S. Cl. ..... 299/12; 299/81.2; 239/288

(58) Field of Search ..... 299/12, 81.1, 81.2, 299/81.3; 239/550, 288, 566

(56) References Cited

U.S. PATENT DOCUMENTS 2,418,766 A * 4/1947 Green ..... 239/431
5,407,253 A * 4/1995 Page et al. ..... 299/12

* cited by examiner

*Primary Examiner*—David Bagnell
*Assistant Examiner*—Brian Halford
(74) *Attorney, Agent, or Firm*—Clark & Brody

(57) ABSTRACT

A water spray assembly especially adapted for control of dust suppression in mining machines has a manifold with one or a number of nozzles mounted thereon. The manifold provides communication between the nozzles and a manifold inlet, the manifold inlet being adapted to connect to a supply of water. The manifold cooperates with a nozzle block having a bore sized to receive at least a portion of the manifold. The block is adapted to be mounted for aiming the nozzles in a particular direction. By having the block sized to receive the manifold, the manifold being removable from the bore to facilitate replacing or cleaning the nozzles.

15 Claims, 3 Drawing Sheets

WATER SPRAY ASSEMBLY

This application claims priority under 35 USC 119(e) based on provisional patent application No. 60/188,170 filed on Mar. 10, 2000, hereby incorporated in its entirety by reference.

FIELD OF THE INVENTION

The present invention is directed to a water spray assembly, and in particular to a water spray assembly for mining equipment employing a removable manifold to facilitate changing of spray nozzles in difficult to reach areas.

BACKGROUND ART

In the prior art, water sprays are used in mining equipment, especially coal mining equipment, to suppress dust and wet the mined product. The sprays include nozzles, which are removably attached to manifolds or blocks, the blocks fixedly mounted to the mining machines at various locations. One problem with these sprays is plugging of the nozzles due to the coal, coal dust, iron oxide, and other foreign matter. The sprays must be continually cleaned for safety reasons and such maintenance reduces mining production. FIG. 1 shows a prior art spray system with a block 1 mounted on a portion of a continuous mining machine 3. The block 1 has a number of nozzles 5. A supply line 7 provides water to the nozzles for spraying purposes via a channel 9 within the block 1. Since these applications and types of mining machines are well known, a further description is not necessary for understanding of the invention.

SUMMARY OF THE INVENTION

It is a first object of the present invention to provide an improved water spray assembly, particularly one that is adapted for use on a mining machine.

Another object of the invention is a water spray assembly that permits easy removal for cleaning and repair.

One other object of the invention is a water spray assembly that utilizes a nozzle block and a manifold that is easily removed from the nozzle.

The invention allows the system to be continuously purged of plugging contaminants which otherwise would accumulate as occurs in prior art systems.

Other objects and advantages of the present invention will become apparent as a description thereof proceeds.

In satisfaction of the foregoing objects and advantages, the present invention provides an improvement in water sprays assemblies, particularly those that are mounted to mining machines for wetting and dust suppression.

The water spray assembly comprises a manifold containing one or more spray nozzles mounted thereto. The manifold has a passageway, which connects inlets of the nozzles to a manifold inlet. The manifold inlet is adapted to connect to a source of pressurized water via a hose or the like.

The manifold is received and supported by a nozzle block or housing. In a preferred embodiment, the housing is adapted to be attached to a location on a mining machine to spray water as part of the mining operation. One or more housings can be attached to the mining machine in a number of orientations and locations depending on the mining machine configuration. Of course, the housing and manifold could be adapted to mate with other components that utilize water sprays.

The nozzle block is configured to removably receive the manifold while providing one or more openings to allow the one or more spray nozzles of the manifold to direct the water spray in a given direction and/or orientation. By having the housing removably receive the manifold, the manifold can be easily removed when the one or more sprays become clogged. Another manifold with unobstructed nozzles can be inserted in the nozzle block while the manifold with the clogged nozzles is cleaned. Moreover, the nozzle block can be positioned on the machine so that an operator or user has ready access to the manifold for easy removal and reinstallation of another manifold.

The manifold can employ one or more nozzles and the nozzles can vary in spray pattern, flow rate, direction of spray and/or a combination of these variables. Virtually any nozzle can be employed in combination with the manifold.

The nozzles can be attached to the manifold by a threaded connection or any other connection as would be within the skill of the art.

The manifold shape is preferably circular in cross section of cylindrical in shape. Other cross sectional shapes could also be employed such as square, octagonal or the like.

The manifold material can be any material suitable for a particular application, but is preferably a material that is corrosion resistant while being capable of removably receiving the nozzles. One example is a nylon block which can be machined with threaded opening for the nozzles and water supply connection.

The water supply to the manifold can be provided by a hose having a threaded fitting which would connect to a threaded opening in the manifold. The connection between the manifold and hose could also be a quick connect fitting to facilitate removal of the manifold from the water supply hose for nozzle cleaning and/or replacement.

The inventive water spray assembly can be used in methods of spraying water, particularly for dust suppression in mining environments such as coal mines. The methods also involve the ability to remove the manifold component of the spray assembly for cleaning and repair, while leaving the housing place.

BRIEF DESCRIPTION OF THE DRAWINGS

Reference is now made to the drawings of the invention wherein.

DESCRIPTION OF THE PREFERRED EMBODIMENTS

The invention offers significant advantages over prior art water spray heads and the like which are fixedly mounted on machines or other equipment, particularly mining machines. The invention eliminates the need to remove one or more nozzles in cramped areas or hard-to access areas on a machine such as a mining machine for nozzle cleaning or replacement. With the inventive water spray assembly, the manifold is easily removed from the housing and replaced with another manifold having clear nozzles. No or hardly any time is lost as part of the nozzle replacement operation, thereby avoiding losses in productivity. In addition, personnel are kept out of harm's way via ease of the replacement procedure.

Figure 1:
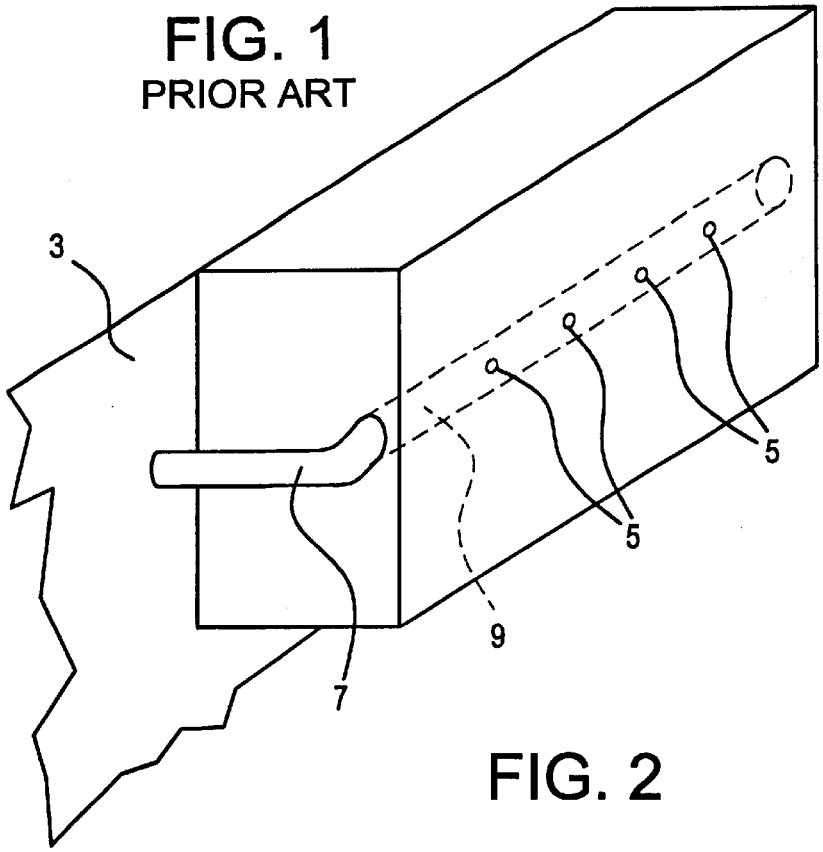
FIG. 1 PRIOR ART
FIG. 1 shows a prior art water spray nozzle arrangement typically used in mining machines.
Figure 2:
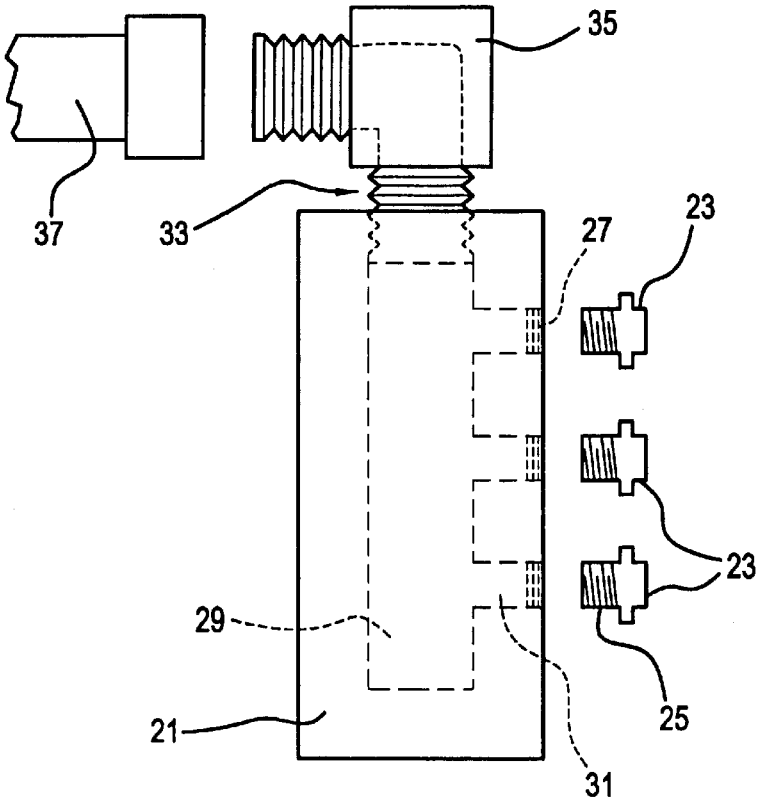
FIG. 2 is a side view of one embodiment of the invention.
Figure 3:
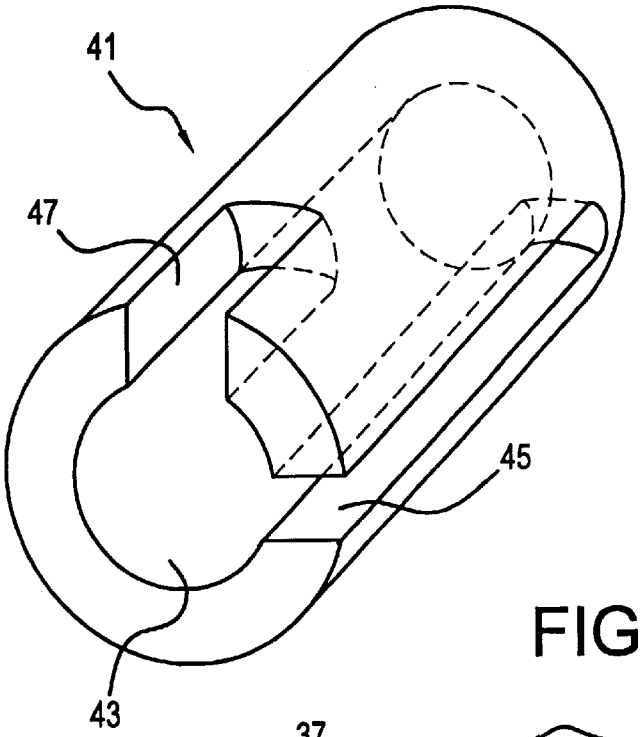
FIG. 3 is a perspective view of the nozzle block of the invention.
Figure 4:
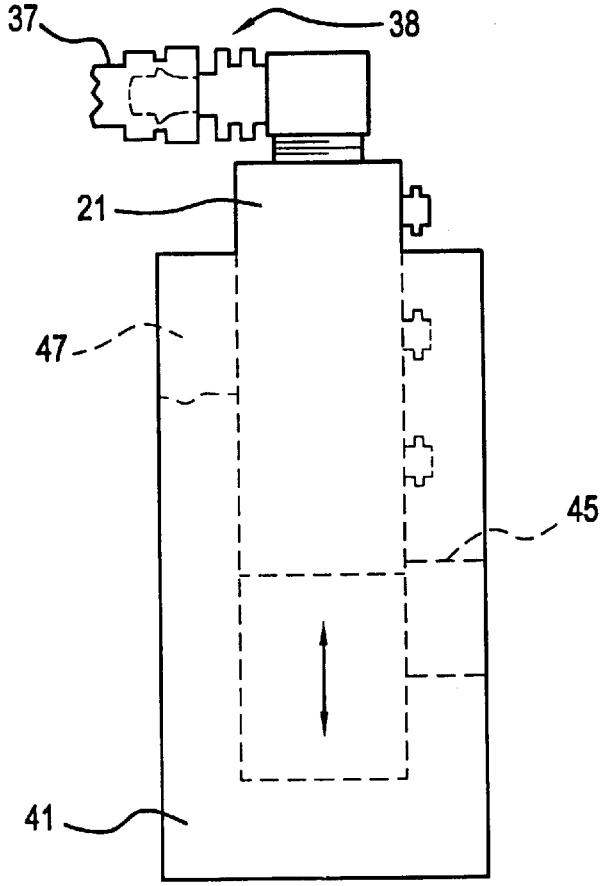
FIG. 4 is a side view of the manifold and the nozzle block in partial engagement.

FIGS. 2–4 show one embodiment of the invention. FIG. 2 shows the manifold 21 having three nozzles 23. The nozzles 23 are threaded at 25 to mate with complementary threaded portions 27 of the manifold. The manifold has a passageway 29 interconnecting the nozzle channels 31 with an inlet 33.

The inlet is preferably threaded to receive a complementary threaded fitting 35. The fitting 35 interconnects the passageway 29 to a supply hose 37 to supply pressurized water to the nozzles 23. The supply hose 37 threads to the fitting 35.

Referring to FIG. 3, the nozzle block is designated as 41 and has a bore 43 sized to receive the manifold 21. The block 41 also has a slot 45 which allows travel of the nozzles when the manifold 21 is inserted into the bore 43 of the block. The manifold 21 can friction fit into the bore 43 or be locked in with some type of a locking mechanism, e.g., a pin, a detent mechanism or the like.

The slot 45 of the block can be sized as shown in FIG. 4 so that the nozzles are recessed from the block outer surface. In this way, the nozzles are more protected from impact from coal, coal dust, other machinery, thereby lessening the chances of nozzle plugging or damage. Of course, the nozzles could be flush with the outer surface of the block or even extend outwardly therefrom is so desired. FIG. 4 also shows a quick connect fitting 38 that links the manifold 21 to the supply hose 37.

The block 41 also can have a cutout 47 which is, sized to accommodate the connection between the water supply and the manifold 21. The cutout 47 is shown at about a 90° from the slot 45 but other orientations could be used, e.g., the slot 45 could be opposite the cutout 47. In other embodiments, the cutout could be optional, e.g., the fitting 35 was not a 90°-type fitting but was aligned with a longitudinal axis of the manifold.

FIG. 4 shows a partial insertion of the manifold 21 into the block 41.

Figure 5C:
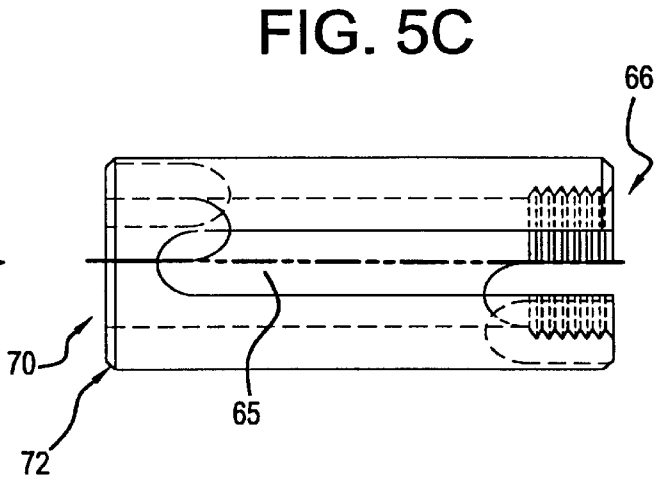
FIG. 5*c* is a front view of the nozzle block of FIG. 5*a;*
Figure 5B:
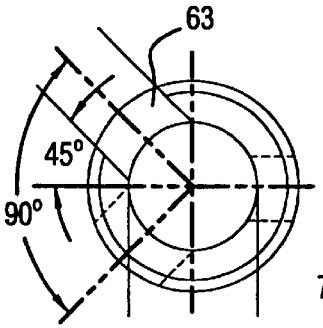
FIG. 5*b* is an end view of the nozzle block of FIG. 5*a;*
Figure 5A:
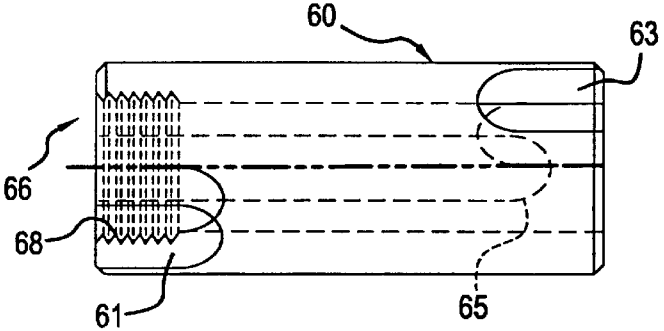
FIG. 5*a* is a back view of a nozzle block of a second embodiment of the invention.

FIGS. 5*a*–*c* and 6*a*–*d* show other embodiments of the block and manifold. The FIGS. 5*a*–5*c* embodiment shows the block with a threaded portion for connection with the manifold. FIG. 5*a* shows a back view of an exemplary 2.5" O.D.×1.5" I.D. steel tube nozzle block 60 showing two end slots 61, and 63. The end view of FIG. 5*b* shows the slots 61 and 63 arranged at a 90° angle. The slots 61 and 63 are preferably 1.5" long, and the end 66 of the tube has a threaded interior portion 68. FIG. 5*c* shows a third slot 65, which runs almost the length of the tube. The end 70 opposite end 66 has a chamfered edge 72, preferably a ⅛" chamfer. Each slot preferably terminates with a ⅜" radius shape.

Figure 6C:
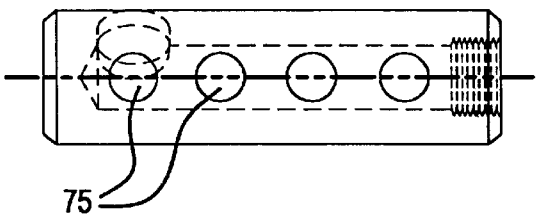
FIG. 6*c* is a front view of the manifold of FIG. 6*a;*.
Figure 6B:
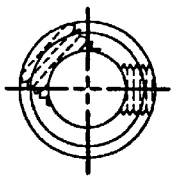
FIG. 6*b* is an end view of the manifold of FIG. 6*a;*
Figure 6D:
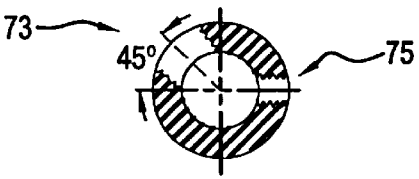
FIG. 6*d* is a sectional view along the line VI—VI of FIG. 6*a.*
Figure 6A:
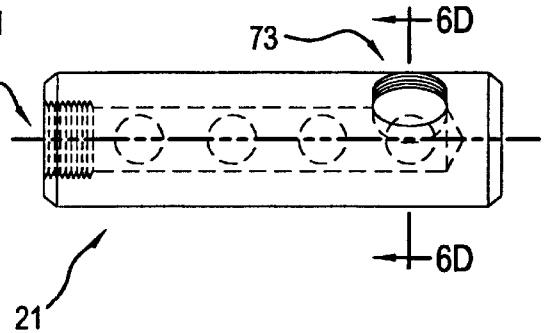
FIG. 6*a* is a back view of a manifold to go with the nozzle block of FIGS. 5*a*–5*c;*

The FIGS. 6*a*–6*c* show a manifold 21' with an inlet 71 and outlet 73. The manifold is preferably a 1.5" O.D. nylon rod. This differs from the FIG. 2 embodiment wherein the manifold has only an inlet. The manifold 21' preferably has a 4.5" deep bore with an opening tapped ¾" deep to ½" pipe. The outlet 73 is drilled and tapped to ½" pipe. FIG. 6*b* shows the relationship between the inlet 71 and the outlet 73, with FIG. 6*c* showing the channels 75 which correspond to the channels 31 of FIG. 2. FIG. 6*d* shows a sectional view wherein the relationship between channels 75 and the outlet 73 are shown. The channels are preferably drilled and left hand tapped to ¼" straight pipe, typically in four places. In the embodiment shown in FIGS. 5 and 6, the assembly can be positioned so that water entering inlet 71 can exit outlet 73 and be directed to other sprays or the like.

Although not shown, the manifold 21 could also have an outlet so that it could be connected to another manifold for a serial hook-up of nozzles.

The manifold could also employ a puller bar on one end thereof to facilitate removal from the block.

The block can be mounted by any means such as welding, fasteners, or the like, and can be either fixedly mounted are adjustably mounted.

As such, an invention has been disclosed in terms of preferred embodiments thereof which fulfills each and every one of the objects of the present invention as set forth above and provides new and improved water spray assembly and its use with mining machine.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A water spray assembly comprising:

a) a manifold having at least one nozzle mounted thereon, the manifold having an interior passageway that provides communication between the one nozzle and a manifold inlet, the manifold inlet adapted to connect to a supply of water; and b) a block having a bore sized to receive at least a portion of the manifold having the interior passageway, an inner surface of the block engaging an outer surface of the manifold, the block adapted to be mounted for supporting the manifold and directing the at least one nozzle in a particular direction, the manifold being removable from the bore so that the at least one nozzle can be cleaned or replaced.

2. The assembly of claim 1 in combination with a mining machine.

3. The assembly of claim 1, further comprising a fitting interconnecting the manifold and the supply of water.

4. The assembly of claim 1, wherein the manifold has an outlet to allow connection to another device requiring a supply of water.

5. A water spray assembly comprising:

a) a manifold having at least one nozzle mounted thereon, the manifold providing communication between the one nozzle and a manifold inlet, the manifold inlet having a fitting adapted to connect to a supply of water; and b) a block having a bore sized to receive at least a portion of the manifold, the block adapted to be mounted for directing the at least one nozzle in a particular direction, the manifold being removable from the bore so that the at least one nozzle can be cleaned or replaced, wherein the fitting is a quick connect and disconnect fitting.

6. A water spray assembly comprising:

a) a manifold having at least one nozzle mounted thereon, the manifold providing communication between the one nozzle and a manifold inlet, the manifold inlet adapted to connect to a supply of water; and b) a block having a bore sized to receive at least a portion of the manifold, the block adapted to be mounted for directing the at least one nozzle in a particular direction, the manifold being removable from the bore so that the at least one nozzle can be cleaned or replaced, wherein the block has a slot in communication with the bore to allow the least one nozzle that extends outwardly from the manifold to travel in the slot when the manifold is inserted into the bore.

7. The assembly of claim 6, wherein the slot is sized so that the at least one nozzle is recessed from an outer surface of the block.

8. A water spray assembly comprising:

a) a manifold having at least one nozzle mounted thereon, the manifold providing communication between the one nozzle and a manifold inlet, the manifold inlet having a fitting adapted to connect to a supply of water; and b) a block having a bore sized to receive at least a portion of the manifold, the block adapted to be mounted for directing the at least one nozzle in a particular direction, the manifold being removable from the bore so that the at least one nozzle can be cleaned or replaced, wherein the block has a cutout to receive at least a portion of the fitting.

9. A water spray assembly comprising:

a) a manifold having at least one nozzle mounted thereon, the manifold providing communication between the one nozzle and a manifold inlet, the manifold inlet adapted to connect to a supply of water and further comprising an outlet to allow connection to another device requiring a supply of water; and b) a block having a bore sized to receive at least a portion of the manifold, the block adapted to be mounted for directing the at least one nozzle in a particular direction, the manifold being removable from the bore so that the at least one nozzle can be cleaned or replaced, wherein the manifold has an outlet to allow connection to another device requiring a supply of water, wherein the block has a slot in communication with the bore to allow the at least one nozzle that extends outwardly from the manifold to travel in the slot when the manifold is inserted into the bore.

10. The assembly of claim 9, wherein the slot is sized so that the at least one nozzle is recessed from an outer surface of the block.

11. The assembly of claim 10, wherein the block has a cutout and the manifold has a fitting adapted to connect to the manifold inlet, the cutout sized to receive at least a portion of a fitting.

12. A method of replacing nozzles in a water spray assembly comprising:

a) providing a water spray assembly having a manifold having at least one nozzle mounted thereon, the manifold having an interior passageway that provides communication between the one nozzle and a manifold inlet, the manifold inlet adapted to connect to a supply of water; and a block having a bore sized to receive at least a portion of the manifold having the interior passageway, an inner surface of the block engaging an outer surface of the manifold, the block adapted to be mounted for supporting the manifold and directing the at least one nozzle in a particular direction, the manifold being removable from the bore so that the at least one nozzle can be cleaned or replaced; and b) positioning the block on a machine so that it is easily accessible by an operator; and c) removing the manifold from the block to clean or replace the at least one nozzle.

13. In a method of at least suppressing dust on a mining machine using water sprays, the improvement comprising:

a) providing a water spray assembly comprising:

i) a manifold having at least one nozzle mounted thereon, the manifold having an interior passageway that provides communication between the one nozzle and a manifold inlet, the manifold inlet adapted to connect to a supply of water; and ii) a block having a bore sized to receive at least a portion of the manifold having the interior passageway, an inner surface of the block engaging an outer surface of the manifold, the block adapted to be mounted for supporting the manifold and directing the at least one nozzle in a particular direction, the manifold being removable from the bore so that the at least one nozzle can be cleaned or replaced; and b) spraying water for said dust suppression by supplying water to the manifold inlet, said water passing through the interior passageway and within the block, and exiting the at least one nozzle.

14. The method of claim 13, wherein the water is sprayed on coal mined by the mining machine.

15. A water spray assembly block for supporting a manifold and directing nozzles of the manifold, the block comprising a block body having a bore therein, the block body including a slot in communication with the bore to allow travel of the nozzles of the manifold when the manifold is engaged in the bore, one end of the bore having a cutout portion sized to receive a fitting of the manifold.

* * * * *